United States Patent [19]

Wise

[11] 4,001,819

[45] Jan. 4, 1977

[54] ALARM SYSTEM FOR COMBINED HAZARD DETECTIONS

[75] Inventor: James W. Wise, Oxon Hill, Md.

[73] Assignee: Wise Security Corporation, Washington, D.C.

[22] Filed: Jan. 31, 1975

[21] Appl. No.: 545,829

[52] U.S. Cl. ..... 340/420; 340/213 R; 340/276; 317/31

[51] Int. Cl.[2] ..... G08B 19/00

[58] Field of Search ..... 340/210, 248 R, 248 A, 340/248 B, 420, 213 R, 276, 409, 255; 317/31, 33 R

[56] References Cited

UNITED STATES PATENTS

| | | | |
|---|---|---|---|
| 3,754,221 | 8/1973 | Stelter | 340/255 |
| 3,808,534 | 4/1974 | Summers et al. | 340/248 A X |
| 3,813,666 | 5/1974 | Gately | 340/248 A |
| 3,836,790 | 9/1974 | Becker | 340/248 A X |

*Primary Examiner*—Alvin H. Waring
*Attorney, Agent, or Firm*—Hyman F. Glass

[57] ABSTRACT

Combined intrusion detection and fire detection, or hazard detections, alarm system incorporating, for example, a plurality of intrusion, or first hazard, detection loop circuits and a plurality of fire, or second hazard, detection loop circuits, all of controlled resistance, operatively associated to a regulated voltage source. Integrated circuit operational amplifiers are operatively associated, or connected, with said detection loop circuits, or protective loops, as comparators to compare the voltage drop across said protective loops with reference voltages to provide sensing of variation in the voltage drop across the respective protective loop corresponding to a short or an open circuit condition having developed in the respective loop by detecting variance of the respective protective loop voltage drop relative to said reference voltages so that open and closed circuit detector devices may be and are connected within the same protective loop and mixed therein. Integrated circuit logic in this alarm system provides memory of the occurrences of security breaches, entry and exit delays, pulsating or steady alarm indication outputs to differentiate between hazard detections, for example, fire breach of security, intrusion breach of security or fire and intrusion breaches of security, and enunciator indication of breach, or breaches, of security in any one protective zone or in any combination of a plurality of said protective zones. Security alarm is also provided to assure correct and proper operation of the system, and individual intrusion protective loops may be and are selectively disabled without disabling the fire protective loop associated with the same protective zone. A protective loop includes a fixed terminating resistance and a pair of wires between said terminating resistance and the pair of terminals thereof so that normally closed alarm detector devices may be and are wired in series with said terminating resistance and normally open detector devices may be and are wired in parallel with said terminating resistance with the same pair of wires.

32 Claims, 9 Drawing Figures

Figure 1:
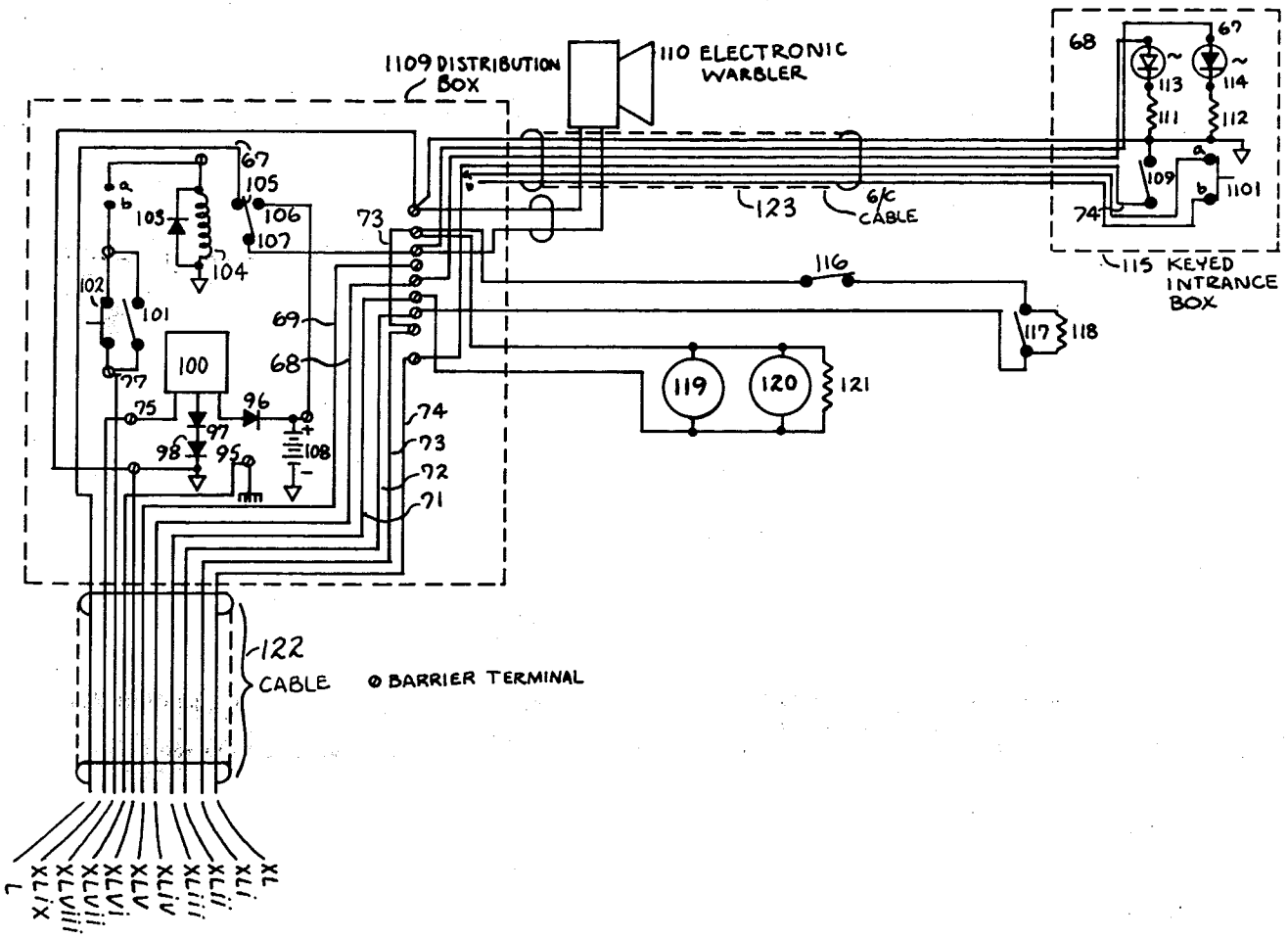

1A = OC DETECTOR - SHORT CIRCUIT DETECTOR
3A = OR GATE
4A = ZONE DISABLE SW. MEMORY FLIP FLOP
5A = ENTRY STATUS INDICATOR, ALARM GATE
6A = OC STATUS INDICATOR
2A = FIRE DETECTOR
7 = ENTRY/EXIT DELAY
8 = RESET
9 = OR GATE
10 = FIRE FLASH ASTABLE
11 = ALARM DETECTOR
13 = INTERNAL ALARM
110 = EXTERNAL ALARM
14 = POWER SUPPLY
1109 = DISTRIBUTION CENTER
121 = FIRE LOOP TERMINATING RESISTOR
120 = FIRE SENSOR (OC)
119 = FIRE SENSOR (OC)
118 = INTRUSION LOOP TERMINATING RESISTOR
117 = INTRUSION LOOP OC SW.
116 = INTRUSION LOOP CC SW.
115 = EXTERNAL DELAYED ENTRANCE KEY SW. WITH SYSTEM ON GREEN STATUS INDICATOR

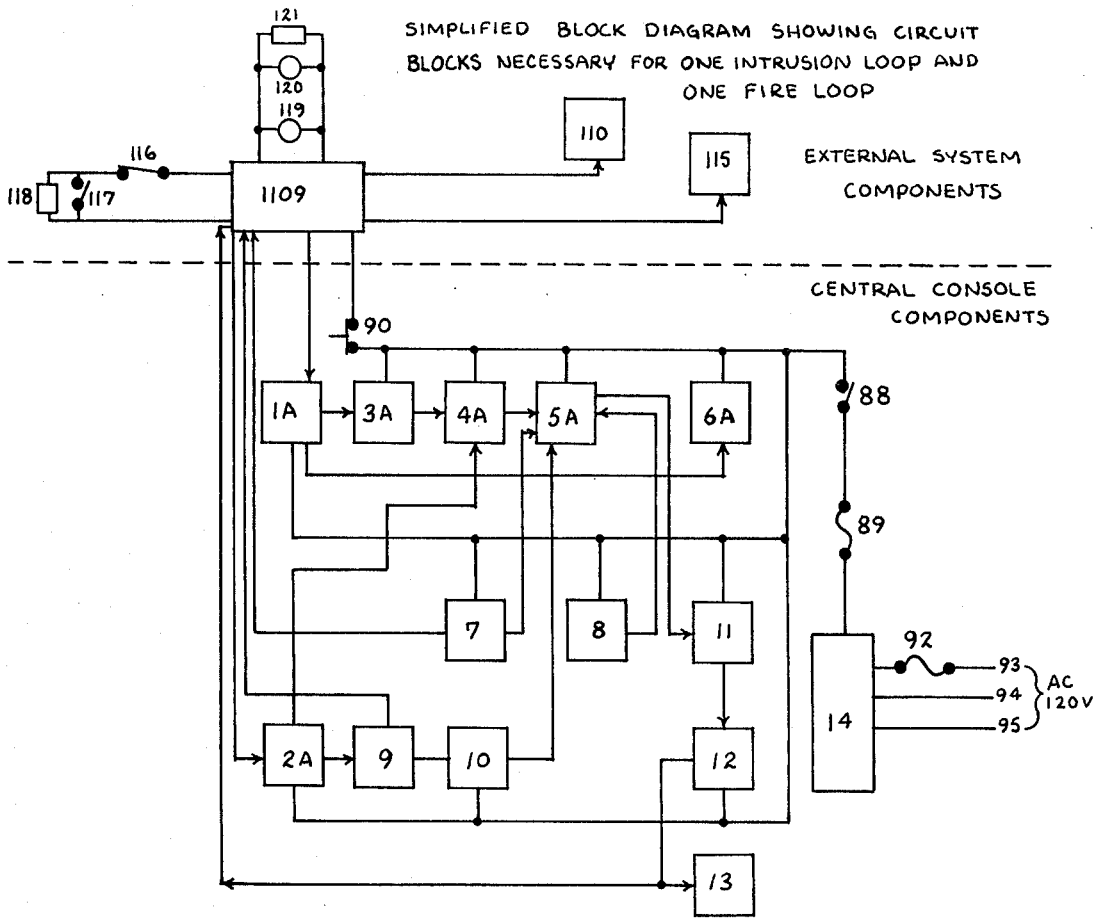

1A = OC DETECTOR - SHORT CIRCUIT DETECTOR
3A = OR GATE
4A = ZONE DISABLE SW. MEMORY FLIP FLOP
5A = ENTRY STATUS INDICATOR, ALARM GATE
6A = OC STATUS INDICATOR
2A = FIRE DETECTOR
7 = ENTRY/EXIT DELAY
8 = RESET
9 = OR GATE
10 = FIRE FLASH ASTABLE
11 = ALARM DETECTOR
12 = ALARM RELAY
13 = INTERNAL ALARM
110 = EXTERNAL ALARM
14 = POWER SUPPLY
1109 = DISTRIBUTION CENTER
121 = FIRE LOOP TERMINATING RESISTOR
120 = FIRE SENSOR (OC)
119 = FIRE SENSOR (OC)
118 = INTRUSION LOOP TERMINATING RESISTOR
117 = INTRUSION LOOP OC SW.
116 = INTRUSION LOOP CC SW.
115 = EXTERNAL DELAYED ENTRANCE KEY SW. WITH SYSTEM ON GREEN STATUS INDICATOR AND ALARM RED STATUS INDICATOR

FIG. 4

ALARM SYSTEM FOR COMBINED HAZARD DETECTIONS

This invention relates to alarm systems and more specifically to alarm systems for combined hazard detections, for example, intrusion detection and fire detection, for indicating such hazards, for example, intrusion and fire.

There exists great need for protection of residence premises and business premises, for example, material storage warehouses, from various types of hazards such as unauthorized entry and fire. Many devices for use in such security or fire-intrusion systems are commercially available, for example, electrically conductive tape to be applied to windows to provide a normally closed circuit which is opened by breaking or opening of the window and various normally open and normally closed switches to be applied to window casings, door casings, trip wires, sky-lights, and the like, for indicating opening or movement thereof. Space alarms, such as radar, Doppler, and ultra-sonic movement detectors are also available which open or close an output circuit upon detection of movement within their range, as are photocell detectors and relays. Also, fire detection devices such as smoke sensors and temperature sensors such as bi-metallic strips and fusable links are well known.

Such available and known detection devices are commonly classified as normally open or normally closed, with the majority of them being of the normally closed type to be connected in series to form an electrically continuous circuit, commonly referred to as a normally closed or closed-loop circuit. Detection devices of the normally open type are commonly connected in parallel to form a parallel electrical circuit, commonly referred to as a normally open or open-loop circuit. Alarm systems for use with such protective or detection circuits are commonly limited for use with only one type of circuit, either closed-loop or open-loop, although some systems have been available capable of use with either type of loop circuit, having connection terminals and sensing means for detecting both open and short circuit conditions within the respective loop circuits. Commonly, however, different connection terminals and sensing means are used for the different types of loop circuits, so that normally open and normally closed detector devices are not and cannot be mixed within the same protective loop or connected with the same pair of wires.

Furthermore, other serious deficiencies of prior art sensing means include excessive power consumption, unreliability, and cost. The sensing means of many prior art systems employed relays, which draw relatively high operating currents, are considerably more expensive than solid state switches and generally are less reliable than solid state devices. Other systems which employed solid state circuitry have been suggested, but likewise are and have been deficient in often being too sensitive, generating an alarm, a false alarm, in response to spurious or noise signals, and in not being capable of reliable use with both open and closed-loop type detector devices or mixed open- and closed-loop circuits and in not being capable of providing a full logic and complete range of protective functions.

The combined hazard detections, for example, intrusion detection and fire detection, alarm system of this invention provides combined fire and intrusion alarms for a plurality of closed or open circuit protective loops of controlled resistance connected to a regulated voltage source. Incorporated in the alarm system of this invention are, for example, a plurality of intrusion, or first hazard, detection loop circuits and a plurality of fire, or second hazard, detection loop circuits of controlled resistance connected to a regulated voltage source. Integrated circuit operational amplifiers are connected with said detection loop circuits, or protective loops, as comparators to compare the voltage drop across said protective loops with reference voltages to provide sensing and an alarm signal in response to variance of the protective loop voltage drop relative the reference voltages to enable open and closed circuit detector devices to be connected, even simultaneously, within the same protective loop and either short or open circuit conditions to be detected. Integrated circuit logic is utilized to and does provide lock-up to record, or memory of, the occurrence of security breaches, to and does provide for entry and exit delays, to and does provide pulsating or steady alarm indication outputs to differentiate between hazard detentions, for example, fire and intrusion breaches of security, to provide automatic switching between an internal battery power source and external power, to provide automatic charging of the battery power source and indication of proper charging function and the presence of external power, and to provide annunciator indications of breaches of security in any of a plurality of protective zones. Security alarm provision is also provided to assure correct operation of the system and individual intrusion protective loops may be and are selectively disabled without disabling the fire protective loop associated with the same protective zone.

The combined fire and intrusion system of the present invention incorporates, for example, a plurality of electrically continuous closed loops for detecting the presence of an intruder and a plurality of electrically continuous loops for detecting a fire wherein breaches in security indicative of fire and intrusion are sensed by a change in direct current due to abnormality in the respective loops. A plurality of linear comparators, which are integrated circuit operational amplifiers, latches or memory circuits, which are integrated circuit bistable multivibrators or flip-flops, and solid state control logic identify individual loop abnormalities, transfer the results to appropriate indicators, store the results and provide visual and/or audible alarm relating to hazards, such as, for example, fire or intrusion.

Each of the intrusion circuits are and can be rendered inoperative or disabled by separate key switches, allowing full or partial intrusion protection. The fire loops are first priority and they are operative at all times. Entry/exit delay, which are solid state, is incorporated in the system, and the visual indicators are also, for example, solid state light emitting diodes.

A plurality of open circuit sensors or detector devices and closed circuit sensors or detector devices can be used in any of the intrusion loops and even mixed within the same loop, connected to the same pair of wires. A plurality of open circuit fire sensors or detectors can be used in the fire loops.

More specifically, the alarm system of this invention is an alarm system for combined hazard detections, and such hazards include, for example, intrusion, or burglary, and fire. This alarm system includes, in combination, a first hazard, such as intrusion, detection loop circuit with at least one first hazard, such as intrusion, detection device for changing the impedance of the detection loop upon the occurrence of a first hazard, such as intrusion, detection, a second hazard, such as fire, detection loop circuit with at least one second hazard, such as fire, detection device for changing the impedance of the second hazard, such as fire, detection loop circuit, upon the occurrence of a second hazard, or fire, incident. In addition, there is included a second hazard, or fire, detection loop circuit having at least one second hazard, such as fire, detection device for changing the impedance of the second hazard, such as fire, detection loop circuit upon the occurrence of a second hazard, such as fire, incident. The system includes means for applying a low voltage signal to each of said first hazard detection loop circuit and said second hazard detection loop circuit. Also present in the system for detecting a change in the impedance of said first hazard, such as intrusion, detection loop circuit is a solid state first hazard, such as intrusion, detecting circuit means, which comprises first integrated circuit operational amplifier comparator means for providing an output signal in response to an impedance change in said first hazard, such as intrusion, detection loop. In addition there are integrated circuit bi-stable multivibrator means connected with the output of said operational amplifier comparator means for providing a memory and a steady output signal continuing even after termination of a transient output signal from said first integrated circuit operational amplifier means, an output indicator device and a transistor indicator driver therefor responsive to an output signal from said memory so that a change in the impedance of said first hazard, such as intrusion, detection loop circuit will give a steady light output from said output indicator device. The system also includes solid state second hazard, such as fire, circuit means for detecting a change in the impedance of said second hazard, such as fire, detection loop circuit, and said solid state second hazard detecting circuit means comprises second integrated circuit operational amplifier comparator means for providing an output signal in response to an impedance change in said second hazard, such as fire, detection loop circuit with integrated circuit astable multivibrator means connected with the output of said second operational amplifier comparator means for providing a pulsating output signal in response to an output signal from said second operational amplifier comparator means. This alarm system includes, in addition, means for connecting said second operational amplifier comparator means with said bi-stable multivibrator means to energize said indicator driver in response to detection of a second hazard, such as fire, incident when said astable multivibrator means is connected with said indicator driver to a non-conducting state so that indicator device is energized continuously to indicate a first hazard, such as intrusion, incident and in a pulsating mode to indicate a second hazard, such as fire, incident.

The alarm system of this invention is such that each protective loop circuit comprises a fixed terminating resistance and a pair of wires connected between the terminating resistances and the terminals for said circuit so that both normally closed alarm detector devices, such as normally closed detection switches, may be wired in series with said terminating resistance and normally open detector devices, such as normally open detection switches, may be wired in parallel with said terminating resistance with the same pair of wires. Saying it another way, either normally open or normally closed detection switches mixed on a single pair of wires are used in any single protective loop.

One of the objects of this invention is to provide an improved alarm system for combined hazard detections, such as intrusion and/or fire, of solid state, integrated circuit components providing high reliability of operation, low current and power requirements and a full range of protective functions.

Another object of this invention is to provide an improved alarm system for combined hazard detections, such as intrusion and/or fire, with a solid-state, integrated circuit alarm sensing circuit capable of being connected to protective loops including either of both normally open and normally closed detection devices.

Another object of this invention is to provide an improved alarm system for combined hazard detections, such as intrusion and/or fire, with solid-state, integrated circuitry providing for connection with a plurality of protective loops and annunciator indication of breaches of security within the respective loops.

Another object of this invention is to provide an improved alarm system for combined hazard detections, such as intrusion and/or fire, with solid-state, integrated circuitry wherein the burglar alarm may be selectively disabled without disabling of the fire alarm.

A further object of this invention is to provide an improved alarm system for combined hazard detections, such as intrusion and/or fire, with self-checking means for indicating the operability of such system.

A still further object of this invention is to provide an improved alarm system for combined hazard detections, such as intrusion and/or fire, with alternate sources of power, including a rechargeable battery, solid state charging circuitry therefor, and solid state switching from and to battery power, further with solid-state indication of the mode of operation.

Other objects and features of this invention will be readily apparent from the following detailed description which is not limited but only illustrative of the preferred embodiments of this invention.

Figure 2:
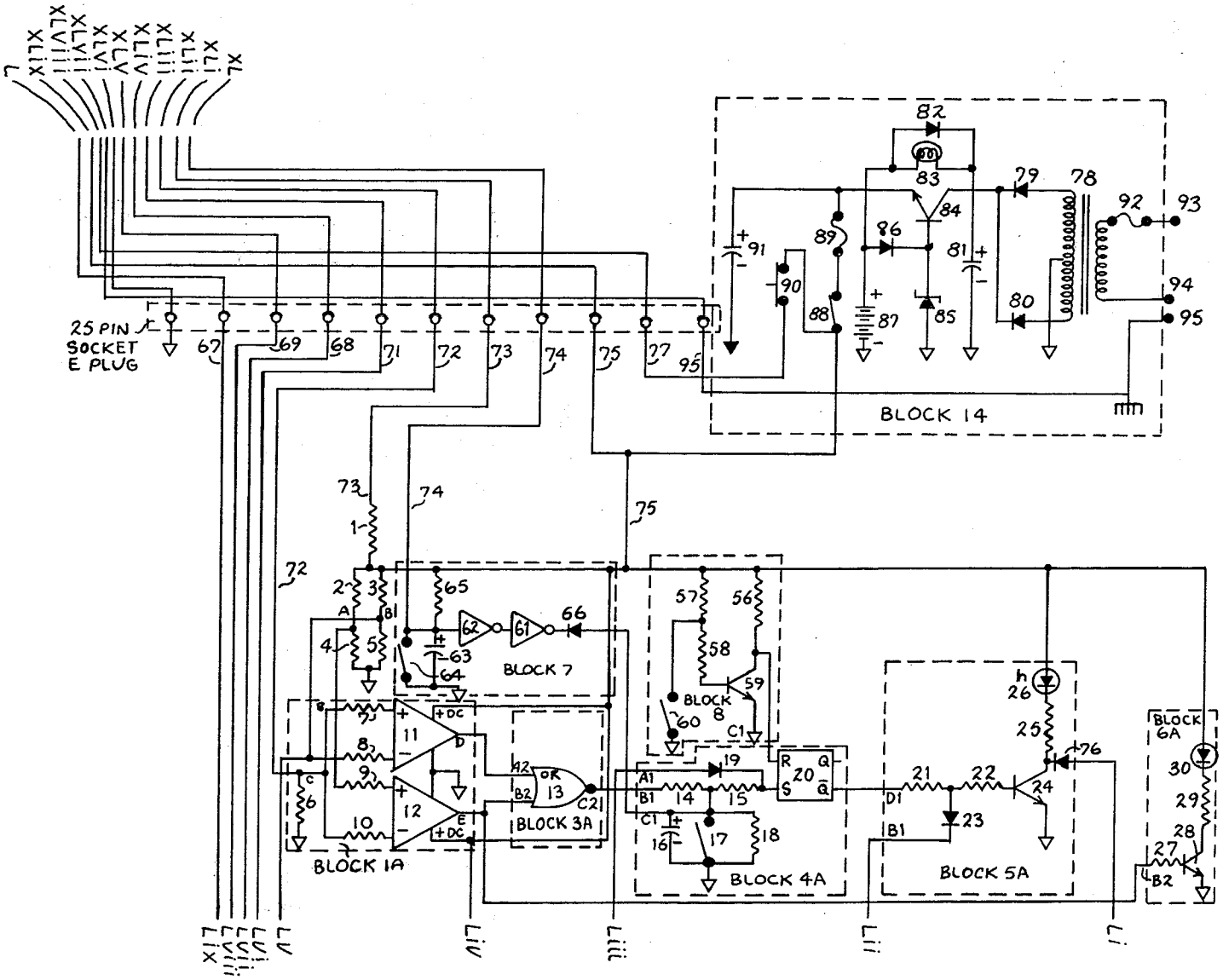
Figure 3:
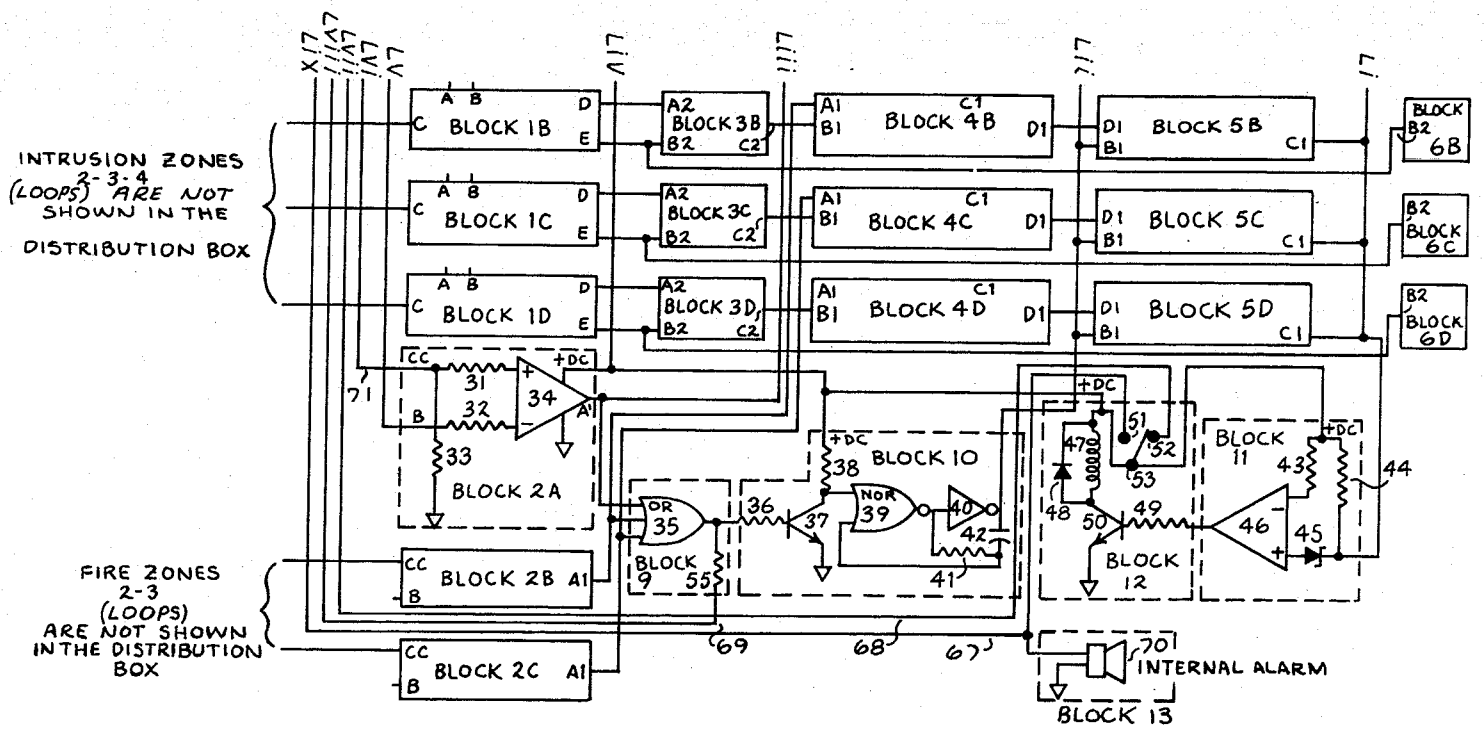
Figure 5:
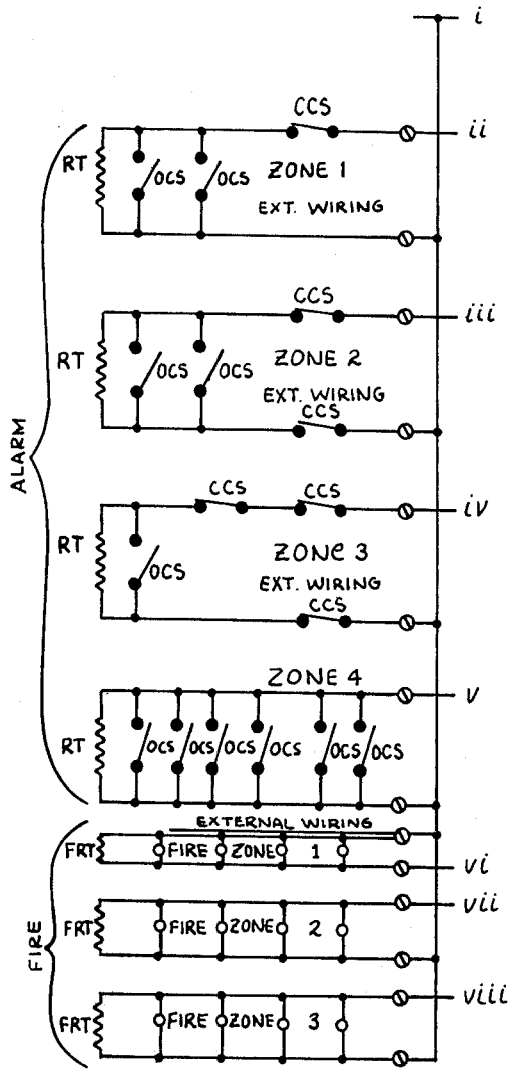

FIGS. 1, 2 and 3 together, with joinder at Roman numerals XL through L (of FIGS. 1 and 2) and with joinder at Roman numerals L*i* through L*ix* (of FIGS. 2 and 3), are a schematic illustration, partially in block form, of a combined hazard detection, such as intrusion and fire, alarm system in accordance with this invention. In FIG. 1, it is to be noted that interlock *ab* of the 6/*c* cable is in series with switch of keyed entrance box 115 and switch 102 of distribution box 1109.

FIG. 4 is a schematic illustration, in block logic form of a simplified version of the alarm system of this invention, as necessary for a single fire detection protective loop and a single intrusion detection protective loop.

FIGS. 5, 6, 7, 8 and 9 together, with joinder at Roman numerals *i* through *viii* (of FIGS. 5 and 6) and with joinder at Roman numerals *ix* through *xxvii* (of FIGS. 6 and 7) and with joinder at Roman numerals *xxviii* through *xxxix* (of FIGS. 7 and 8) and with joinder at 1C and 1D (of FIGS. 7 and 9) and 1A, 1B and 1E (of FIGS. 8 and 9), together are a detailed schematic diagram of a combined intrusion detection and fire detection alarm system, with four intrusion detection protective loops and three fire detection protective loops.

Elements or groups of elements which are conventional and generally widely known in the field to which the alarm system of this invention relates of course form a part of the alarm system of this invention herein described, and their exact nature or type is not described in detail for the reason that a person skilled in the art can understand and use and make the alarm system of this invention, after it will have been disclosed to him in accordance with this description, without a detailed recitation of such conventional and generally widely known elements or groups of elements.

FIGS. 1 through 9 are part of this descriptive portion of the specification.

More specifically, with particular reference to FIGS. 1, 2 and 3 herein, there is shown and illustrated a combined fire and intrusion or burglar alarm system constructed in accordance with the principles of this invention. The alarm system therein shown in said FIGS. 1 through 3 comprises, in general, a console containing the sensing and control logic circuitry (to be described in detail hereinafter), a remotely locatable distribution box containing additional circuitry (to be described in detail hereinafter) designated 1109 connected thereto by a cable 122, a power supply identified as BLOCK 14 which can be within, adjacent, or remote from said console, an entrance switch box 115 providing keyed access and system status indication with the entrance switch box 115 being connected with the distribution box 1109 by a connecting cable 123. As hereinbefore set forth, interlock *ab* of cable 123 (6/*c*) is in series with switch 1101 of keyed entrance box 115 and switch 102 of distribution box 1109.

The alarm system of said FIGS. 1 through 3 shows in detail only one intrusion or burglar detecting loop and only one fire detection loop, together with details of the associated sensing and logic circuitry within the console for those particular intrusion or burglar protection or detection loop and fire detection loop, although the console and diagram thereof is provided with means for connection of up to four intrusion loops and three fire loops. The sensing and logic for the remaining loops are shown only in block form. It is to be expressly understood that the number of intrusion loops and the number of fire loops is not critical to the present invention and that any desired number of each of same may be provided by appropriate provision of additional redundant sensing and logic circuits within said console.

FIGS. 1 through 3 show the alarm system partially in schematic form and partially in block form, illustrating in full schematic form the circuitry for a single intrusion loop and a single fire loop while the redundant duplicative circuitry for an additional three intrusion loop and an additional two fire loops are illustrated in only block form.

In said FIGS. 1 through 3, there is also shown an external alarm device 110 which may comprise, for example, an electronic warbler siren and which may be located at any desired location together with an internal alarm 70 which is preferably within the console or adjacent thereto.

In FIGS. 1 through 3, the redundant blocks are identified by the suffixes A, B, C, D, with the block A in each case being shown schematically. Hence, BLOCK 1 is depicted schematically and is identified as BLOCK 1A, with BLOCKS 1B, 1C, and 1D being schematically identical thereto and being shown only as blocks to reduce the size of the figure and make it easier to follow. This scheme has been used in connection with all blocks having alphabetical notation following or as a suffix to the numeric identity or reference character.

In the following logic description of the operation of the alarm system of the present invention, the logic symbols are used as hereinafter explained.

The small circle at the output of a device (as shown in said drawings) indicates that the device is inverting and the absence thereof indicates that the device is a non-inverting device. In keeping with accepted standards, $\overline{Q}$ is NOT Q, or the reverse or inversion of Q. Q = I. $\overline{Q} = \phi$ ($\phi$ is the symbol used herein for Zero, or for the state not that of I in the binary system having only I and $\phi$). As used herein, and for the purposes of illustration and logical analyses only, $\phi$ is zero volts D.C. while I is +12 volts D.C.

Again, with reference to FIGS. 1 through 3, the intrusion and fire loops are all common or in series to resistor 1, which performs a current limiting function, preventing excessive power supply current from damaging the power supply in the event of a short circuit to system ground from any of the electrically closed loops. Resistor 1 also serves as a part of the voltage divider network formed by the intrusion and fire loops, as described more fully hereinafter.

Continuity in the intrusion loop shown is established from the +12 volts D.C. power supply BLOCK 14 through resistor 1, line 73, through the cable 122 to the distribution box 1109, through the closed circuit detector switch or alarm sensor 116, through the loop terminating resistor 118, returning through the distribution box 1109 via line 72, through the connecting cable 122 to the junction of resistors 6, 7, and 10, of BLOCK 1A. More than one closed circuit switch 116 may, of course, be connected in the loop, in series with the closed circuit switch 116 illustrated. Additionally, there may be one or more open circuit switches 117 within the same loop, connected with the same pair of wires, and connected in parallel across the terminating resistor 118.

The series connected current limiting resistor 1, loop terminating resistor 118, and the resistor 6 constitute a voltage divider loop connected across the power supply BLOCK 14 and together therewith define a voltage source for providing a detection voltage across the terminals of the protective loop which will be at first value if the series connected closed circuit switches 116 are all closed and the parallel connected open circuit switches 117 are all open (and if no other open or short circuit conditions exist), with such first value defining a non-alarm condition. The voltage across the terminals of the protective loop will change upon the short-circuiting or open-circuiting of the protective loop, through either operation of any of the switches 116 and 117 or through any circuit fault. Any such change in the voltage across the terminals of the protective loop will be sensed by the BLOCK 1A.

BLOCK 1A comprises a state of the art integrated circuit operational amplifier 11 connected for use as a comparator. This comparator is used to detect a short circuit across the intrusion loop. BLOCK 1A further comprises a second state of the art integrated circuit operational amplifier 12 also connected for use as a comparator. This comparator 12 is used to detect an open circuit in the intrusion loop. The comparators 11 and 12 detect short and open circuit conditions in the intrusion loop by comparing the voltage drop across the intrusion loop to first and second reference voltages less than and greater than the normal voltage drop across a properly operating intrusion loop, respectively, sensing a short circuit condition by lowering of the voltage drop across the intrusion loop and an open circuit condition by raising of the voltage drop across the intrusion loop outside of the range separating the reference voltages, respectively.

Now, with reference first to the open circuit detector 12, the junction of resistor 6 and the electrically closed intrusion loop supply a D.C. current to the negative terminal of the open circuit detector 12. The junction of resistors 2 and 4, noted as Point A, supply a D.C. current to the positive terminal of the open circuit detector 12 that is less than the current supplied to the negative terminal of the open circuit detector 12, resulting in a $\phi$ output of detector 12. The resistors 9 and 10 are preferably of the order of 1 megohm each to provide excellent isolation and transient protection to the positive and negative terminals of the operational amplifier 12, inasmuch as they are connected between the respective junctions and the comparator (operational amplifier) terminals.

The point B at the junction of resistors 3 and 5 supplies a D.C. current through resistor 8 to the negative terminal of comparator (operational amplifier) 11 that is larger in magnitude than the current supplied to the positive terminal thereof from the electrically closed intrusion loop through resistor 7 in normal operation thereof to the comparator positive terminal, resulting in a $\phi$ output of detector or comparator 12 under normal conditions within the intrusion loop.

Accordingly, resistors 2 and 4 form a voltage divider connected across the power supply BLOCK 14 and resistors 3 and 5 form a second voltage divider connected across the power supply BLOCK 14 to define therewith first and second reference source means, respectively, for comparison with the voltage drop across the protection loop.

The outputs of the two comparators or operational amplifiers (detectors) 11 and 12 in BLOCK 1A are connected to the inputs of the OR gate 13, BLOCK 3A. The output of comparator 12 in BLOCK 1A also is connected to the input of BLOCK 6A. The first abnormal loop condition is the normally closed switch (sensor) 116 being open (or some other open circuit fault within the intrusion loop), resulting in no current to the positive input of comparator 11 and the negative input of comparator 12. Comparator 11 will not change output state, remaining at an output $\phi$. Comparator 12, however, will change its output state from $\phi$ to I. The output I applied to the input of BLOCK 6A will turn on transistor 28 through resistor 27. When transistor 28 turns on, it will forward bias the light emitting diode 30 through resistor 29, producing a bright red light that indicates an open circuit in the electrically closed loop.

The output of OR gate 13 of BLOCK 3A is connected to the input of BLOCK 4A. If the switch 17 in BLOCK 4A is in the OFF position, there will be no alarm. In the OFF position switch 17 is closed, and the output of the OR gate 13 of BLOCK 3A is diverted to ground.

If the switch 17 is in the ON (open) position, Input I to BLOCK 4A will charge capacitor 16 to state I and set the latch 20 through resistors 14 and 15. $\overline{Q}$ output will change the output of the latch 20 from $\phi$ to I. $\overline{Q}$ will stay at a state I until manually reset. $\overline{Q}$ state I is connected to the input of BLOCK 5A and turns on transistor 24 through resistors 21 and 22.

Light emitting diode 26 is thereby forward biased through resistor 25 and transistor 24, producing a bright red light. Hence, in the event of an open circuit alarm condition, both the loop entry and open circuit indicators will be on. A short circuit alarm, on the other hand, will only trigger the loop entry light emitting diode 26, and not the open circuit diode 30. The loop entry and open circuit indicators 26 and 30, respectively, relate the breach of security visually.

The alarm detector comparator BLOCK 11 comprises operational amplifier comparator 46, resistors 43 and 44, and zener diode 45. The comparator 46 positive terminal is supplied a D.C. current from the 12 volt D.C. power supply BLOCK 14 through resistor 43. The negative terminal is supplied a D.C. current of greater magnitude than the positive current via resistor 44 and zener diode 45, resulting in an output $\phi$ from the comparator 46. The junction of resistor 44 and zener diode 45 is connected to the anode of the diode 76 of BLOCK 5A. When the transistor 24 of BLOCK 5A is on (indicating an alarm condition), its collector to emitter resistance is very low and it forward biases the diode 76, which diverts the current at the junction of resistor 44 and zener diode 45 of BLOCK 11 to ground. The decrease of current into the negative terminal of comparator 46 changes the state of the comparator 46 to output I. Output I of comparator 46 is connected to the input of BLOCK 12 turning on transistor 50 thereof through resistor 49. The ON state of transistor 50 energizes the relay 47, closing contacts 53 and 51 thereof to apply 12 volts D.C. to point 67 and energize the internal electronic alarm. The 12 volts D.C. is routed through the cable 122 to the distribution box 1109, through relay 104 contacts 105 and 107, to the external electronic warbler siren 110 and to the red status indicator light emitting diode 114 in the entrance switch box 115.

Hence, upon the detection of an alarm, the internal alarm 70, BLOCK 13, the external alarm 110 and the red alarm status indicator 114 in the entrance switch box 115 are all switched on, together with the respective entry alarm light emitting diode 26.

The entrance switch box 115 is also provided with a green status operational indicator comprising a green light emitting diode 113, which is turned off via the contact 52 of BLOCK 12 when an alarm condition exists.

The system may be and can be reset manually by the spring loaded key switch 60 in BLOCK 8. Transistor 59 in BLOCK 8 is normally turned on through resistors 57 and 58, resulting in a condition $\phi$ at the collector of transistor 59 and the resistor 56. The collector of transistor 59 is connected to the reset of the latch 20 in BLOCK 4A. The spring loaded switch 60 is connected between the junction of resistors 57 and 58 and system ground. When spring loaded switch 60 is closed, the collector of transistor 59 is changed to produce an output I. This output I resets the latch 20 (application thereof to reset terminal R thereof) of BLOCK 4A, turning off the alarm and alarm indicators. The green SYSTEM ON indicator 113 in keyed entrance box 115 turns ON and lights, via contacts 52 and 53 of relay 47 in BLOCK 12.

The junction B of resistors 3 and 5 supplies D.C. current to the negative terminal of comparator 11, BLOCK 1A, through resistor 8. The voltage of the D.C. current is higher in magnitude than that supplied to the positive terminal of comparator 11 from the electrically closed loop through resistor 7, resulting in an output $\phi$ from comparator 11 which is the short circuit detector or sensor. If the open circuit switch 117 in the intrusion loop is closed (or if other short circuit fault exists), the loop current supplying the positive terminal of operational amplifier comparator 11 will be much greater in magnitude than the current to the negative terminal, resulting in an output I from the comparator 11. This output I from the comparator 11 is connected to one input of the OR gate 13, BLOCk 3A. The output of OR gate 13, BLOCk 3A, is connected to the input of BLOCK 4A, and BLOCK 4A will operate as hereinbefore set forth.

The electrically closed fire loop contains only open circuit fire sensors (open circuit heat activated switches) although other open circuit devices, such as smoke or gas detectors may also be connected in parallel thereto, as is well known in the art. In FIGS. 1 through 3 are shown only two open circuit fire sensors 119 and 120, but any number may be connected in parallel.

Loop continuity of the fire detection loop is established from the positive 12 volt D.C. power supply BLOCK 14 through resistor 1, line 73, through the cable to the distribution box 1109, through resistor 121 defining a loop terminating resistor similar to the intrusion loop terminating resistor 118, through the cable 122 to the junction of resistors 31 and 33, BLOCK 2A, supplying current to the positive terminal of operational amplifier comparator 34 through resistor 31. The negative terminal of the comparator 34 is connected with point B, the junction of resistors 3 and 5 similarly to the connection of the intrusion loop short circuit comparator or detector 11, and the operation of the comparator 34 is similar to the comparator 11, hereinbefore described, producing an output $\phi$ under normal conditions, changing to an output I if the fire detector loop is shorted, as by closing of one of the fire sensors 119 or 120.

The output I of the fire comparator 34 in BLOCK 2A is connected to the input of both BLOCK 4A and one input of the three input OR gate 35 in BLOCK 9, wherein is resistor 55 connected as shown, to cause an output I which is coupled to the distribution center barrier terminal of point 69 for optional equipment control.

The input I to the BLOCk 4A is coupled past resistors 14, 18, and 15 and past capacitor 16 and disabling switch 17 directly to the set input S of the latch 20, regardless of the position of disabling switch 17. The $\overline{Q}$ output of latch 20 changes to output I, which is connected to the input of BLOCK 5A as hereinbefore described.

Simultaneously, the output I connected to BLOCK 9 from BLOCK 2A changes OR gate 35 to output I which is coupled to the distribution box 1109 through resistor 55 via point 69 and to BLOCK 10 through resistor 36 to turn on transistor 37. The collector of transistor 37 is normally at state I through resistor 38 from the positive 12 volt D.C. power supply, BLOCk 14. When transistor 37 is turned on, the collector drops to an output $\phi$, activating the alarm fire pulser, BLOCK 10, comprising NOR gate 39, inverter 40, capacitor 42 and resistor 41. Input I to the two input NOR gate 39 changes it to output I from output $\phi$. The output I from NOR gate 39 is applied to the input of the inverter 40 and changes its output to output $\phi$. Capacitor 42 is therefore then tied to system ground through the output $\phi$ at the output of the inverter 40. The other end of the capacitor 42 is connected to 12 volts through resistor 41 and the output I at the output of the two input NOR gate 39. Capacitor 42 will now start charging towards full charge I through resistor 41. When the junction of capacitor 42 and resistor 41 place an output I on the other input to the two input NOR gate 39, its output will change to output $\phi$, reinitiating the charging cycle by discharging the capacitor 42.

This changing of states will continue at a rate determined by the time constant of capacitor 42 and resistor 41, pulsing the output of the inverter 40, BLOCK 10, between outputs $\phi$ and 1.

When the output of the inverter 40 of BLOCK 10 is $\phi$, it forward biases diode 23 of BLOCk 5A, diverting the current from the junction of resistors 21 and 22 through the $\phi$ output of the inverter 40 of BLOCK 10, and turns off transistor 24, thereby blanking the light emitting diode 26, the alarms, the status indicator (red) in the external entry key switch box 115 and turns on the SYSTEM ON (green) indicator 113. When the output of said inverter 40 changes to I, the alarms and the indicators turn on. Said indicators turn on and off at the rate of the fire pulser, providing an unmistakable indication of fire. The latch 20 of BLOCK 4A cannot be reset until the fire loop is in the electrically open condition.

The console and all external devices connected thereto via the multiconductor cable 122, as shown to be connected by socket and plug to ground and points 67, 69, 68, 71, 72, 73, 74, 75, 77 and 95, are supervised or interlocked, so that any fault or disruption thereof produces an alarm. The distribution box 1109 contains a separate battery 108, power integrated voltage regulator and a supervisory relay with two interlock switches, one key operated and one pressure operated. The distribution box 1109 is therefore supervised and independent of the main power supply BLOCK 14.

The supervisory relay 104 (in distribution box 1109) is normally maintained energized from the positive 12 volts D.C. power supply, BLOCK 14, in the console through pressure type closed circuit console switch 90, point 77, the cable 122, pressure type distribution box closed circuit cover switch 102 (parallel connected with key switch 101 for authorized inspection, etc.) to system ground. Contacts 105 and 107 of switches 105, 106, 107 in said distribution box 1109 are thereby closed maintaining continuity to alarm relay 47 (BLOCK 12) contacts 51, 52, 53 via point 67, to the external electronic warbler siren 110. If either switch 90 (BLOCK 14) or switch 102 (in distribution box 1109) is opened or the cable 122 is unplugged, cut, or the like, relay 104 will be deenergized, contact 107 will close to contact 106 and the distribution box battery 108 will turn on the electronic warbler siren 110.

The distribution box battery 108 is float charged by the power integrated circuit 100, which is supplied by the positive 12 volt D.C. power supply, BLOCK 14, through fuse 89, power switch 88, through point 75 and the cable 122 to the distribution box 1109. Diode 96 prevents the battery from feeding back into the power integrated circuit 100 when D.C. power from the console fails or the system is turned off. Diodes 97 and 98 raise the output voltage of the regulator to compensate for the forward voltage drop of diode 96 and provide for 0.6 volts additional above the battery voltage to float charge the battery 108.

The console power supply, BLOCK 14, comprises a transformer 78 providing 25.2 v. center tapped supplied from an A.C. power line from point 93 through fuse 92 and from point 94. Point 95 is a power line earth bond connected to the chassis of all internal and external devices within the system. A fullwave center tapped positive D.C. output is generated by transformer 78, diodes 79 and 80, capacitor 81, series pass transistor 84, incandescent lamp 83, diode 86, capacitor 91 and zener diode 85.

The output from the unregulated fullwave rectifier is approximately 18 volts D.C. and is connected to the power transistor collector as well as the power transistor base and the zener diode 85 through the incandescent lamp 83 which is a 12 volt, 0.2 amp indicator lamp, through diode 86. The junction of the lamp and the diode 86 are connected to the battery 87. The lamp 83 charges the battery 87 with a current proportional to the difference between the unregulated voltage and the battery 87 voltage.

The battery voltage is clamped at the zener voltage (12 volts) plus the diode forward voltage drop which averages 0.6 volts. The emitter of transistor 84 maintains a regulated D.C. voltage to all components in the system (12 volts, D.C.).

If the A.C. power should be disconnected or fail for any reason, the battery 87 will maintain system power through diodes 86 and 82. Said two diodes 86 and 82 force the transistor 84 to become, in effect, merely two forward biased diodes (base to emitter and collector to emitter) when there is no A.C. power. Power supply voltage is supplied to the system through fuse 89 and D.C. power switch 88.

A direct short circuit from the positive 12 volt D.C. line would blow fuse 89, resulting in the energizing of the electronic warbler siren 110 through contacts 106 and 107 of supervisory relay 104, to provide fail-safe operation. The closed circuit switch 1101 in the entry switch box 115 can be connected in the supervisory circuit or in any one of the four intrusion loops, or additional closed circuit switches may be included.

Attention is now directed to the simplified Block Diagram of FIG. 4 showing circuit blocks necessary for one intrusion loop and one fire loop of the alarm system of this invention, with only the circuit blocks necessary for such a simplified system being shown therein. The foregoing descriptive subject matter and the FIGS. 1 through 3 informational subject matter is to be considered together with and are to be applied for purposes of description by those skilled in the art to the blocks depicted or shown in FIG. 4, with identical reference characters and informational matter, and Block identification numbers, and nomenclatures being used for the various blocks shown and depicted in this FIG. 4 as are and were utilized in the description, including the FIGS. 1 through 3, of the full service alarm system as shown and depicted in FIGS. 1 through 3.

As is clearly shown in FIG. 2 of FIGS. 1 through 3 and in FIG. 4, BLOCK 7 depicts the entry/exit delay portion of the alarm system of this invention, and therein are shown, in proper connecting relationship, switch 64, resistor 65, capacitor 63, inverters 63 and 61 and diode 64. The block diagram of FIG. 4 illustrates the functional relationship of the alarm system component parts and component circuits of this invention in a simplified form. With further reference to FIGS. 1 through 3 and to FIG. 4, the various enumerated Blocks and components are as follows, with note that the Blocks are shown by dotted lines in FIGS. 1 through 3:

1A is open circuit or short circuit detector; 2A is fire detector; 3A is OR gate; 4A is zone disable switch memory flip-flop; 5A is entry status indicator, alarm gate; 6A is open circuit status indicator; 7 is entry/exit delay; 8 is reset; 9 is OR gate; 10 is fire flash astable; 11 is alarm detector; 12 is alarm relay; 13 is internal alarm; 14 is power supply; 1109 is distribution center or box; 110 is external alarm; 115 is external delayed entrance key switch with system on green status and alarm red status indicators; 118 is intrusion loop terminating resistor; 88 is D.C. power switch; 89 is D.C. power fuse; 92 is A.C. fuse; 93, 94 and 95 are A.C. power line connections; 116 is intrusion loop closed circuit switch; 117 is intrusion loop open circuit switch; 119 is fire sensor (open circuit); 120 is fire sensor (open circuit); and 121 is fire loop terminating resistor.

As is clearly shown in said FIG. 4, external components of the alarm system of this invention are shown above the dotted line and the central console components are shown below said dotted line.

Figure 9:
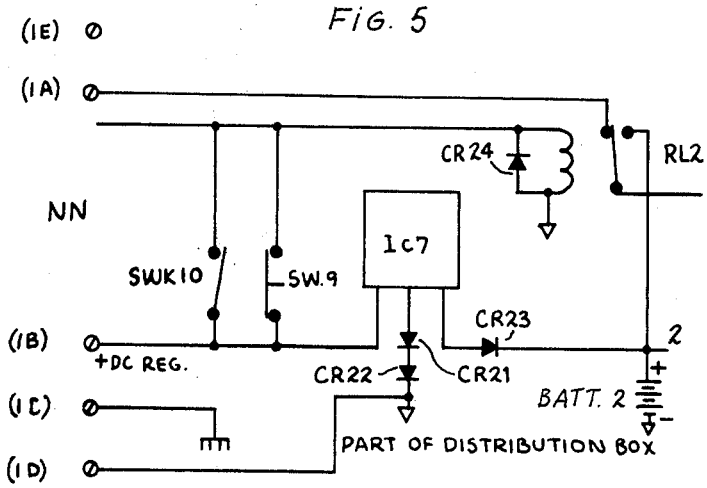
Figure 8:
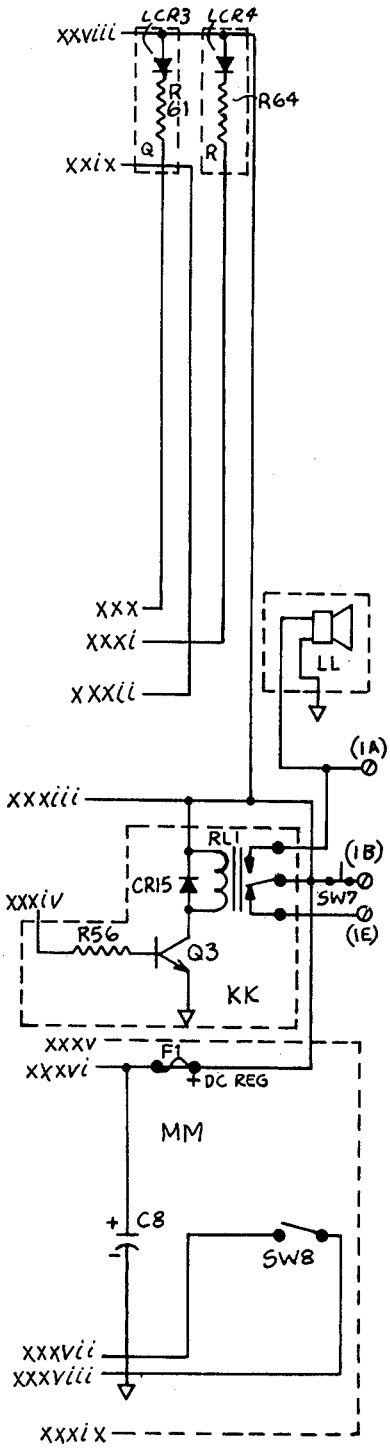
Figure 6:
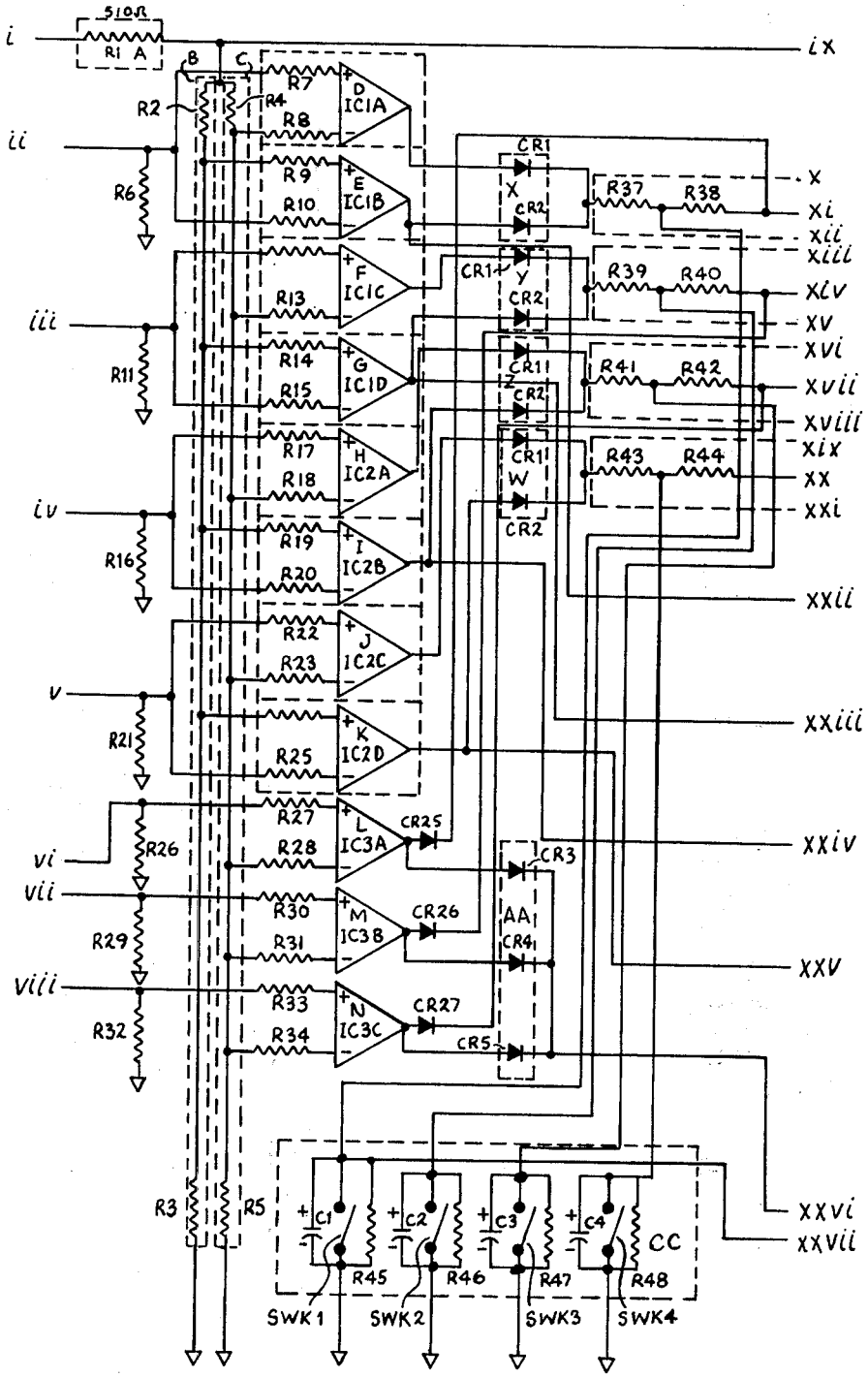
Figure 7:
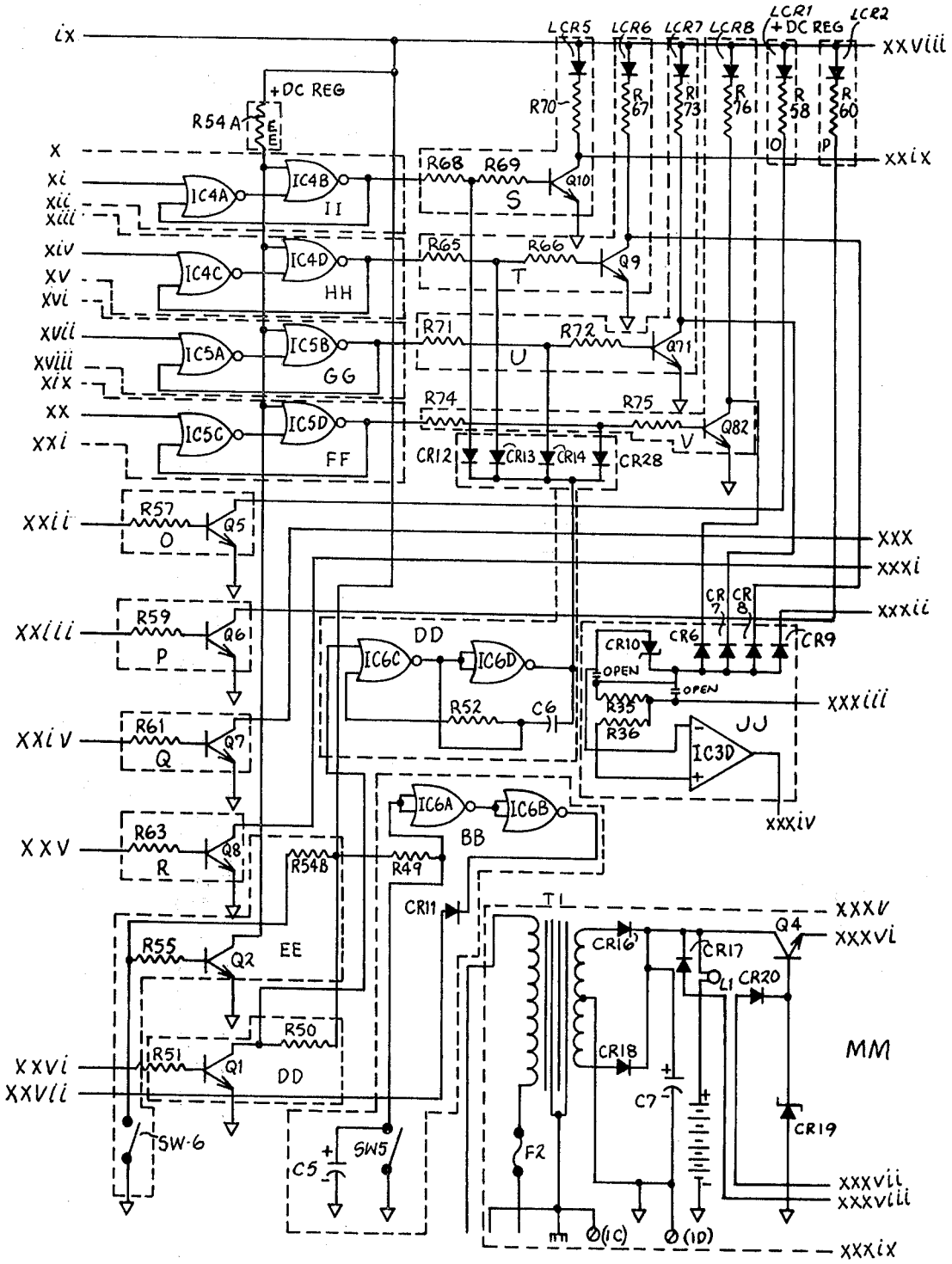

FIGS. 5 through 9 illustrate in full schematic form a working example of the alarm system of this invention with four intrusion detection zones and three fire detection zones. FIGS. 1 through 3 being hereinbefore set forth to depict or show the alarm system of this invention in partial block and partial schematic forms for a full alarm system and FIG. 4 being hereinbefore set forth to depict or show the alarm system of this invention in full block form with respect to a portion of the alarm system of this invention. Said FIGS. 5 through 9, with FIG. 9 showing a part of the distribution box, show the blocks thereof superimposed on the schematic in dotted or broken lines with alphabetic callout of said blocks in upper case letters, for example, A, B, C, and so on, and AA, BB, CC, and so on, with the components thereof, as hereinafter described. Block A is the current limiter and includes 510 ohms ½ watt 5% resistor R1. Block B is comparator reference, open circuit comparator, with resistors R2 and R3 being 10,000 ohms ½ watt 5% or 11,000 ohms ½ watt 5%. Block C is comparator reference, open circuit comparator, with resistors R4 being 10,000 ohms ½ watt 5% or 11,000 ohms ½ watt 5% and R5 being 100,000 ohms ½ watt 5% or 110,000 ohms ½ watt 5%. Each of Blocks W, X, Y and Z has a diode CR1 and a diode CR2, said diodes being IN 4001 diodes, and all of said diodes are in two diode OR gate circuits. Block W is the zone 4 two diode gate. Block X is the zone 1 two diode OR gate. Block Y is the zone 2 two diode OR gate. Block Z is the zone 3 two diode OR gate. Block AA is the fire activate three diode OR gate and has diodes CR3, CR4 and CR5 which are IN 4001 diodes. Block D is zone 1 entry (closed circuit) comparator and has the following components: resistor R6, 56,000 ohms ½ watt 5%; resistors R7 and R8, each being 1 megohm ½ watt 5 or 10%, and IC1A, ¼ of LM 3900 "quad operational amplifier". Block E is zone 1 open circuit comparator and has resistors R9 and R10, each 1 megohm ½ watt 5 or 10%, and IC1B, ¼ of LM 3900 "quad operational amplifier". Block F is zone two entry comparator and has resistor R11, 56,000 ohms ½ watt 5%, resistors R12 and R13; each 1 megohm ½ watt 5 or 10% and IC1C, ¼ of LM 3900 "quad operational amplifier". Block G is zone 2 open circuit comparator and has resistors R4 and R5, each 1 megohm ½ watt 5 or 10% and IC1D, ¼ of LM 3900 "quad operational amplifier". Block H is zone 3 entry comparator and has resistor R16, 56,000 ohms ½ watt 5%, resistors R17 and R18, each 1 megohm ½ watt 5% or 10%, and IC2A, ¼ of LM 3900 "quad operational amplifier". Block I is zone 3 open circuit comparator and has resistors R19 and R20, each 1 megohm ½ watt 5 or 10%, and IC2B, ¼ of LM 3900 "quad operational amplifier". Block J is zone 4 entry comparator and has resistor R21, 56,000 ohms ½ watt 5%, resistors R22 and R23, each 1 megohm ½ watt 5 or 10%, and IC2C, ¼ of LM 3900 "quad operational amplifier". Block K is zone 4 open circuit comparator and has resistors R24 and R25, each 1 megohom ½ watt 5 or 10%, and IC2D, ¼ of LM 3900 "quad operational amplifier". Block L is zone 1 fire comparator and has resistor R26, 56,000 ohms ½ watt 5%, diode CR25, IN4001, resistors R27 and R28, each 1 megohm ½ watt 5 or 10%, and IC3A, ¼ of LM 3900 "quad operational amplifier". Block M is zone 2 fire comparator and has resistor R29, 56,000 ohms ½ watt 5%, diode CR26, IN4001, resistors R30 and R31, each 1 megohm ½ watt 5 or 10%, and IC3B, ¼ of LM 3900 "quad operational amplifier". Block N is zone 3 fire comparator and has resistor R32, 56,000 ohms ½ watt 5%, resistors R33 and R34, each 1 megohm ½ watt 5 or 10%, and IC3C, ¼ of LM 3900 "quad operational amplifier". Block JJ is alarm gate or alarm detector and has IN4001 diodes CR6, CR7, CR8 and CR9, IN748A 3.9 volt zener diode CR10, 56,000 ohm ½ watt 5% resistor R35, 100,000 ohm ½ watt 5% or 110,000 ohm ½ watt 5% resistor R36 and ¼ of LM 3900 "quad operational amplifier" IC3D. Block II is zone 1 memory (bi-stable flip-flop multivibrator) and has 10,000 ohm ½ watt 5% or 11,000 ohm ½ watt 5% resistors R37 and R38 and ½ of each of CD4001AE quad 2 input NOR gates IC4A and IC4B. Block HH is zone 2 memory (bi-stable flip-flop multivibrator) and has 10,000 ohm ½ watt 5% or 11,000 ohm ½ watt 5% resistors R39 and R40 and ½ of each of CD4001AE IC4C and IC4D quad 2 input NOR gates. Block GG is zone 3 memory (bi-stable flip-flop multivibrator) and has 10,000 ohm ½ watt 5% or 11,000 ohm ½ resistors R41 and R42 and ½ of each of CD4001AE quad 2 input NOR gates. Block FF is zone 4 memory (bi-stable flip-flop multivibrator) and has 10,000 ohm ½ watt 5% or 11,000 ohm ½watt 5% resistors R43 and R44 and ½ of each of CD4001AE quad 2 input NOR gates. Block CC is zones disable circuits and has 10 mfd 20 or 25 volt capacitors C1, C2, C3 and C4, 100,000 ohm ½ watt 5% or 110,000 ohm ½ watt 5% resistors R45, R46, R47 and R48, and key operated single pole, single throw switches SWK 1, SWK 2, SWK 3 and SWK 4. Block BB is zone 1 entrance/exit delay and has 2 or 2.2 megohm ½ watt 5% resistor R49, bat handled momentary SPDT switch, 47 mfd 25 volts, or equivalent selected value, capacitor C5, ½ of each of CD4001AE quad 2 input NOR gates IC6A and IC6B, and IN4001 diode CR11. Block DD is flash astable circuit and has 22,000 ohm ½ watt 5% or 20,000 ohm ½ watt 5% resistors R50 and R51, 10 megohm ½ watt 10% resistor R52, 4700 ohm ½ watt 5% resistor R53, 1 mfd 200 volts capacitor C6, IN4001 diodes CR28, CR12, CR13 and CR14, and ½ of each of CD4001AE quad 2 input NOR gates IC6C and IC6D, and 2N3904 transistor Q1. Block EE is memory master reset and has 4700 ohm ½ watt 5% resistors R54 and R55, 22,000 ohm ½ watt 5% or 20,000 ohm ½ watt 5% resistor R54A, spring return key operated normally open switch SW6 and 2N3904 transistor Q2. It is to be noted that the two EE Blocks in FIG. 7 have the same alpha. Block KK is alarm driver and system on circuit and has IN 4001 diode CR15, 91–774 SPDT 12 volt relay RL1, 22,000 ohm ½ watt 5% or 20,000 ohm ½ watt 5% resistor R56 and 2N3904 transistor Q3. In Block LL is shown 6 to 28 volt D.C. Mallory Sonalert console audio alarm. In Blocks O, P, Q and R are red light emitting diodes LCR1, LCR2, LCR3 and LCR4, 390 ohm ½ watt 5% resistors R58, R60, R62 and R64, 22,000 ohm ½ watt 5% or 20,000 ohm ½ watt 5% resistors R57, R59, R61 and R63, and 2N3904 transistors Q5, Q6, Q7 and Q8, as shown. Blocks O, P, Q and R are open circuit indicator drivers for zones 1, 2, 3 and 4, respectively. The power supply is shown in Block MM and has 117 volt No. 25.2 volt center tapped 2 amps transformer T1, 2A Littlefuse No. 312002 fuse F1, 1A Littlefuse No. 312001 fuse F2, IN4001 diodes CR16, CR18, CR17 and CR20, 1200 mfd 35 volt capacitor C7, 1000 mfd 16 volt capacitor C8, IN3022B 12 volt 1 watt 5% zener diode CR19, 2N5294 power transistor Q4, pressure, normally open interlock switch SW7, battery + D.C. SPST switch SW8, 1892 lamp L1, and Globe GC1245 4.5 ampere hour, or equivalent, battery BATT. 1. Block S is zone/entry/fire indicator driver. Block T is zone 2 entry/fire indicator driver. Block U is zone 3 entry/fire indicator driver. Block V is zone 4 entry indicator driver. Now, with respect to said Blocks S, T, U and V, therein, as shown in FIG. 7, are red light emitting diodes LCR5, LCR6 and LCR7 and LCR8, 22,000 ohm ½ watt 5% or 20,000 ohm ½ watt 5% resistors R68, R69, R71, R72, R65, R66, R74 and R75, 390 ohm ½ watt 5% resistors R67, R70, R73 and R76, and 2N3904 transistors Q9, Q10, Q11 and Q12.

Block NN (FIG. 9) depicts or illustrates a portion of the distribution box with interlock and 6 volt supply. The component elements thereof are LM340T6 precision integrated circuit voltage regulator, 6 volts output, IC7, key operated single pole, single throw switch SWK10, pressure operated, normally open interlock switch SW9, D1–974 SPDT 12 volt relay RL2, Globe GC610–1, 1 ampere hour battery BATT. 2 and IN diodes CR21, CR22, CR23 and CR24.

The operation of the alarm system of FIGS. 5 through 9 and of the so-set forth circuit component blocks and, of course, the so-set forth component elements is identical to the operation of the alarm system as hereinbefore described with reference to the schematic and block portions of FIGS. 1 through 3 and 4 and the descriptive subject matter relating thereto, all of the Figures and the descriptive subject matter herein constituting the descriptive portion of this Application, which also includes the appended claims.

The alarm system of this invention as illustrated in FIGS. 5 through 9 and as hereinbefore further described is a fire/intrusion system with four electrically continuous closed loops for detecting intrusion at a plurality of locations in each loop and three electrically continuous loops for detecting fire at a plurality of locations in each loop wherein breaches indicative of intrusion and fire are sensed by a change in direct current because of abnormality in the respective loops. A plurality of linear comparators, flip-flops (latches) and control logic identify individual loop abnormalities transfer the results to the appropriate indicators, store the results and provide visual and/or audible alarm relating to intrusion and/or fire. Each of the intrusion circuits is and can be rendered inoperative by separate key switches, thereby allowing full or partial intrusion detection and/or fire detection. The three fire loops are operative at all times. Entry/exit delay is incorporated. Each of the visual indicators are light emitting diodes and should never have to be replaced. A plurality of open circuit sensors and closed circuit sensors are and can be used in each of the intrusion loops; a plurality of open circuit fire sensors are and can be used in each of the fire loops.

Particular attention is directed to the description of various of the described diodes, for example, diodes CR21, CR22, CR23 and CR24 in Block NN. The descriptive matter IN4001 is also sometimes referred to as 1N4001, and, therefore, "IN4001" and "1N4001" are the same descriptive terminologies.

The alarm system of this invention has been described by the FIGS. 1 through 9 and the descriptive subject matter relating thereto, and many alterations and changes may be made without departing from the spirit and scope of this invention which is set forth in the appended claims which are to be construed as broadly as possible in view of the prior art. The scope of this invention is to be determined by the claims hereof.

I claim:

1. Alarm system comprising, in combination, first voltage source means for providing a first reference voltage, second voltage source means for providing a second reference voltage, third voltage source means for providing a detection voltage across a pair of terminals for a protective loop circuit within a protective zone, comparator means for comparing the voltage drop developed across said terminals with said first and second reference voltages, and alarm indicator means connected with said comparator means for producing an output signal if the voltage drop across said terminals is not intermediate said first and second reference voltages, said comparator means comprising first comparator means for providing a signal output in response to detecting a voltage drop across said pair of terminals greater than both said first and said second reference voltages and second comparator means for providing a signal output in response to detecting a voltage drop across said terminals less than both said first and said second reference voltages, each of said first comparator means and said second comparator means comprising an integrated circuit operational amplifier, said pair of terminals for a protective loop circuit within a protective zone being connected across both the positive input of one said integrated circuit operational amplifiers and the negative input of the other of said integrated circuit operational amplifiers, respectively, and said first and said second reference voltages being connected across the negative input of said one of said integrated circuit operational amplifiers and the positive input of said other of said integrated circuit operational amplifiers so that one or the other of said integrated circuit operational amplifiers will provide an output voltage signal if the voltage drop across said pair of terminals is not intermediate said first and said second reference voltages thereby to signal an alarm condition existing within said protective loop and so that an exceedingly small current is required through said protective loop and a very small voltage thereby to provide high sensitivity and safety with minimal operating expense and long battery life.

2. The alarm system of claim 1 wherein said alarm indicator means further comprises an OR gate connected with the outputs of both said amplifiers for providing an alarm signal if either amplifier signals existence of an alarm condition within protective loop.

3. The alarm system of claim 2 wherein said alarm indicator means further comprises solid state memory means connected with the output of said OR gate for maintaining an output voltage signal even after cessation of detection of an alarm condition within the protective loop until operator reset thereof, together with reset means manually operable for enabling selective operator reset of said memory means to a non-output, non-alarm indicating condition thereof.

4. The alarm system of claim 3 further comprising disabling switch means which comprises bi-stable switch means connected to the input of said memory means and means connecting one side thereof to system ground to enable selective manual disabling of the protective loop by leaving said switch in the grounding position thereof to short any output voltage from said comparators to ground and preclude triggering of the memory thereby.

5. The alarm system of claim 3 wherein said memory means comprises a bi-stable solid state multivibrator.

6. The alarm system of claim 5 wherein said bi-stable multivibrator comprises a pair of cross-coupled back-to-back connected integrated circuit NOR gates.

7. The alarm system of claim 6 further comprising manually operable bi-stable reset and disabling switch means for selectively shorting an input of one of said NOR gates to system ground to enable resetting of said memory means thereby to a non-output voltage state and selective maintenance thereof in a non-alarm condition responsive state for disabling of the associated protective loop.

8. The alarm system of claim 7 wherein said alarm indicator means further comprises a loop alarm indicator comprising solid state indicator driver means connected with the output of said memory means and with a solid state indicator device such as a light emitting diode for indicating an alarm condition in existence in the protective loop connected with the respective pair of terminals.

9. The alarm system of claim 8 further comprising at least one additional voltage source means for providing an additional detection voltage across an additional pair of terminals for connection of an additional protective loop thereto, an additional protective loop connected to said additional pair of terminals, and at least one additional pair of comparators and a memory means and loop alarm indicator associated therewith to enable said additional protective loop for an additional protective zone to be simultaneously monitored, together with an OR gate connected with both said loop alarm indicators for providing a general system alarm output voltage signal when any of the loop alarm indicators are activated.

10. The alarm system of claim 9 further comprising integrated circuit comparator means for responding to said general system alarm signal voltage and alarm indicator output driver means responsive thereto for providing a system alarm in response to the generation of one or more loop alarms.

11. The alarm system of claim 10 wherein said integrated circuit comparator means comprises an integrated circuit operational amplifier comparing the voltage state across each of said alarm indicator output driver means with a fixed reference voltage so that, when one or more of the alarm indicator output driver means conduct to light the associated indicator, the voltage drop across the conducting driver means decreases and triggers the comparator to an output voltage condition.

12. The alarm system of claim 8 further comprising an additional protective loop, fourth voltage source means, connected to said additional protective loop, for providing a second detection voltage across a second pair of terminals for said second protective loop circuit so that second protective loop circuit may be provided within said protective zone, comparator means for comparing the voltage drop across said second pair of terminals with the voltage of one of said first and said second voltage sources and providing an output alarm signal if the voltage drop across said second pair of terminals decreases to less than the compared voltage thereby responding to a shorted condition with such second protective loop circuit, and connecting means for connecting the output signal of said comparator means with said memory means and providing an output signal from said memory means upon alarm condition detection by said second comparator means irrespective of the position of said reset and disabling switch means so that said first protective loop within said protective zone may be selectively manually disabled without disabling said second protective loop within said protective zone and said indicator device will indicate an alarm condition within said protective zone in either of said first and said second protective loops within said protective zone.

13. The alarm system of claim 12 wherein said connecting means comprises resistance means for providing a voltage drop between said memory means and said reset and disabling switch means when a signal is applied to the input of said memory means between said resistance means and said memory means to isolate such signal from grounding through said reset and disabling switch means and isolation means for passing an alarm output from the output of said second comparator means to said memory means input between said resistance means and said memory means while blocking any signal flowing to said memory means through said resistance means from the first mentioned comparator means from being applied to the output of said second comparator means.

14. The alarm system of claim 13 wherein said second comparator means comprises an integrated circuit operational amplifier and said isolation means includes a solid state diode.

15. The alarm system of claim 14 further comprising flashing means for responding to an alarm signal output from said second comparator means to blank periodically said solid state indicator driver means so that said light emitting diode will flash to indicate an alarm condition in said second protective loop of said protective zone and remain lighted steadily if an alarm condition is present in said protective loop of said protective zone only.

16. The alarm system of claim 15 wherein said flashing means comprises an astable multivibrator and transistor switch means operatively associated with the output of said second comparator means and said astable multivibrator for turning on said astable multivibrator in response to detection of an alarm condition within second protective loop, and means for connecting the output of said astable multivibrator with said indicator driver means to blank said indicator driver means in one state of said astable multivibrator and not to blank said indicator driver means in the other state of said astable multivibrator.

17. The alarm system of claim 16 comprising a plurality of protective loops and a single flasher means responsive thereto and further comprising a diode OR gate connected between the respective protective loop comparators and said transistor switch means for providing isolation between said comparators together with a plurality of parallel isolation switching diodes connected between the respective indicator driver means and said astable multivibrator.

18. The alarm system of claim 9 further comprising common reset means for resetting all of said memory means to a non-alarm condition, a NOR gate, said common reset means including manually switchable transistor switch means for grounding an input of a NOR gate of all of said memory means so that all of said memory means are turned off thereby.

19. The alarm system of claim 2 further comprising discriminator means for indicating a distinction between open and shorted circuit alarm conditions across said pair of terminals, said discriminator means including, in turn, first indicator light means connected with the output of said OR gate for lighting in response to either one of an open and a shorted circuit alarm condition, a second indicator light and means connected with the output of only one of said comparators for lighting said second indicator light only in response to an output signal from that comparator so that both said first indicator light means and said second indicator light will be lit in the one instance and only said first indicator light means will be lit in the other instance.

20. The alarm system of claim 19 wherein said means connected with the output of only one of said comparators includes a transistor switch connected with one of said comparators responsive to an open-circuit alarm condition.

21. The alarm system of claim 6 further including arming delay means for selectively disabling the alarm for a time period enabling delay in signalling of an alarm condition after detection thereof, said delay means comprising, in turn, a pair of series connected NOR gates having their respective inputs shorted together to define logic inverters, means for connecting the output of said series connected NOR gates with an input of one of said memory means bistable multivibrator NOR gates, manual switch means for selectively connecting the input of said series connected NOR gates to ground thereby to preclude production of an output alarm signal from said memory means, and a timing capacitor connected across said manual switch means together with a controlled rate changing circuit therefor so that, upon opening of said manual switch means, said timing capacitor maintains said memory means non-responsive only during the charging time of said timing capacitor and renders said memory means responsive as said timing capacitor becomes charged.

22. Alarm system comprising, in combination, first voltage source means for providing a first reference voltage, second voltage souce means for providing a second reference voltage, third voltage source means for providing a detection voltage across a pair of terminals for a protective loop circuit within a protective zone, comparator means for comparing the voltage drop developed across said terminals with said first and second reference voltages, and alarm indicator means connected with said comparator means for producing an output signal if the voltage drop across said terminals is not intermediate said first and second reference voltages, said first voltage source means and second voltage source means each comprising a voltage divider network including, in turn, at least two series connected resistances with a tap connection therebetween and a regulated D.C. power supply common to both sources, each of said voltage divider networks being series connected between said regulated D.C. power supply and a system ground and said third voltage source means comprising an additional voltage divider network connected between said regulated D.C. power supply and said system ground, said additional voltage divider network including, in its turn, at least one current limiting resistor series connected between said regulated D.C. power supply and one of said pair of terminals, and at least one additional resistor series connected between the other of said pair of terminals and said system ground.

23. The alarm system of claim 22 wherein said regulated D.C. power supply includes a step-down transformer, a rectifier and filter means for providing low voltage direct current from and A.C. power line, voltage regulator circuit means connected thereto for providing a regulated output, said voltage regulator circuit means comprising a power transistor having its emitter and collector connected said rectifier output and loads and the base connected to system ground through a zener diode, and a series connected lamp and storage battery connected in parallel with said voltage regulator circuit means across said filter means output, a battery charging circuit operatively associated with said battery, said lamp defining current limiter means for said battery charging circuit, together with a reverse connected diode connected with said filter means output in parallel with said lamp and a forward connected diode connected between the junction of said lamp and battery, on one hand, and the junction of said zener diode and said transistor base, on the other hand, so that, when A.C. power is available, said lamp will be lit, said battery will be maintained charged and regulated D.C. will be provided across the output load while, when A.C. power fails, said battery will supply the load through said diodes and said transistor and said lamp will not be lit to indicate A.C. power failure.

24. The alarm system of claim 23 including a control console, a distribution box and a single cable means for connecting said console and said distribution box, said D.C. power supply so that such single cable means need carry low voltage wiring only.

25. Alarm system for combined hazard detections comprising, in combination, a first hazard detection loop circuit having at least one first hazard detection device for changing the impedence of the detection loop upon the occurrence of a first hazard detection, a second hazard detection loop circuit having at least one second hazard detection device for changing the impedance of the second hazard detection loop circuit upon the occurrence of a second hazard incident, means for applying a low voltage signal to each of said first hazard detection loop circuit and said second hazard detection loop circuit, solid state first hazard detecting circuit means for detecting a change in the impedance of said first hazard detection loop circuit, said solid state first hazard detecting circuit means comprising first integrated circuit operational amplifier comparator means for providing an output signal in response to an impedance change in said first hazard detection loop, integrated circuit bi-stable multivibrator means connected with the output of said first operational amplifier comparator means for providing a memory and a steady output signal continuing even after termination of a transient output signal from said operational amplifier comparator means, an output indicator device and a transistor indicator driver therefore responsive to an output signal from said memory so that a change in the impedance of said first hazard detection loop circuit will give a steady light output from said output indicator device, solid state second hazard circuit means for detecting a change in the impedance of said second hazard detection loop circuit, said solid state second hazard detecting circuit means comprising second integrated circuit operational amplifier comparator means for providing an output signal in response to an impedance change in said second hazard detection loop circuit, integrated circuit astable multivibrator means connected with the output of said second operational amplifier comparator means for providing a pulsating output signal in response to an output signal from said second operational amplifier comparator means, and means for connecting said second operational amplifier comparator means with said bi-stable multivibrator means to energize said indicator driver in response to detection of a second hazard incident when said astable multivibrator means is connected with said indicator driver so that the pulsating output thereof pulses said indicator driver to a non-conducting state so that indicator device is energized continuously to indicate a first hazard incident and in a pulsating mode to indicate a second hazard incident.

26. The alarm system of claim 25 further comprising manually operable disabling switch means for selectively disabling only said first hazard detection loop circuit by selectively ground the output of said first integrated circuit operational amplifier comparator means together with isolation means for isolating said disabling switch means from the output of said second operational amplifier comparator means to maintain functioning of said second hazard detection loop circuit at all times.

27. The alarm system of claim 25 having a plurality of first hazard detection loop circuits and a plurality of second detection loop circuits together with separate integrated circuit operational amplifier comparator means bi-stable multivibrators, output indicator devices and transistor indicator drivers for each pair of one first hazard detection loop circuit and one second hazard detection loop circuit, an OR gate connecting the operational amplifier comparator means outputs of the second hazard detection loop circuits to the same said astable multivibrator and an OR gate connecting each of said indicator drivers with said astable multivibrator so that detection of a second hazard incident pulsates all of said indicator drivers.

28. The alarm system of claim 27 further comprising an alarm detector system for detecting the presence of an output from any of said indicator drivers and providing a general system alarm in response thereto which will be steady in the event of a first hazard incident and pulsate in the event of a second hazard incident.

29. The alarm system of claim 25 wherein said first hazard is intrusion and said second hazard is fire.

30. The alarm system of claim 29 further comprising manually operable disabling switch means for selectively disabling only said intrusion detection loop circuit by selectively grounding the output of said first integrated circuit operational amplifier comparator means together with isolation means for isolating said disabling switch means from the output of said second operational amplifier comparator means to maintain functioning of said fire detection loop circuit at all times.

31. The alarm system of claim 29 having a plurality of intrusion detection loop circuits and a plurality of fire detection loop circuits together with separate integrated circuit operational amplifier comparator means, bi-stable multivibrators, output indicator devices and transistor indicator drivers for each pair of one intrusion detection loop circuit and one fire detection loop circuit, an OR gate connecting the operational amplifier comparator means outputs of the fire detection loop circuits to the same said astable multivibrator and an OR gate connection each of said indicator drivers with said astable multivibrator so that detection of a fire incident pulsates all of said indicator drivers.

32. The alarm system of claim 31 further comprising an alarm detector system for detecting the presence of an output from any of said indicator drivers and providing a general system alarm in response thereto which will be steady in the event of an intrusion incident and pulsate in the event of a fire incident.

* * * * *